US007708671B2

(12) United States Patent
Burkhardt

(10) Patent No.: US 7,708,671 B2
(45) Date of Patent: May 4, 2010

(54) WELLNESS APPARATUS

(76) Inventor: Andrea Burkhardt, Landsberger Strasse 16, Bad Wörishofen (DE) 86825

( * ) Notice: Subject to any disclaimer, the term of this patent is extended or adjusted under 35 U.S.C. 154(b) by 377 days.

(21) Appl. No.: 10/162,078

(22) Filed: Jun. 5, 2002

(65) Prior Publication Data

US 2003/0054925 A1 Mar. 20, 2003

(30) Foreign Application Priority Data

Jun. 6, 2001 (DE) ..... 101 27 319

(51) Int. Cl.
*A63B 21/00* (2006.01)

(52) U.S. Cl. ..... 482/92; 482/93; 482/50; 482/106

(58) Field of Classification Search ..... 482/44, 482/50, 74, 92, 93, 105–110, 114, 148; D21/679
See application file for complete search history.

(56) References Cited

U.S. PATENT DOCUMENTS

| | | | | | |
|---|---|---|---|---|---|
| 1,254,974 | A | | 1/1918 | Briggs | |
| 4,480,828 | A | * | 11/1984 | Kifferstein | 482/74 |
| 4,593,903 | A | * | 6/1986 | Waitz | 482/93 |
| 4,664,373 | A | | 5/1987 | Hait | |
| 4,964,633 | A | * | 10/1990 | Hymanson | 482/110 |
| 5,004,226 | A | | 4/1991 | Brown, Jr. | |
| 5,135,455 | A | * | 8/1992 | King et al. | 482/108 |
| 5,147,262 | A | * | 9/1992 | Hymanson | 482/110 |
| 5,300,002 | A | * | 4/1994 | Freye | 482/114 |
| 5,407,413 | A | * | 4/1995 | Kupferman | 482/106 |
| 5,435,800 | A | * | 7/1995 | Nelson | 482/108 |
| D365,861 | S | * | 1/1996 | Moss et al. | D21/679 |
| 5,536,227 | A | * | 7/1996 | Polchek et al. | 482/93 |
| 5,788,608 | A | * | 8/1998 | Wilkinson | 482/51 |
| 5,839,996 | A | * | 11/1998 | Gooding | 482/106 |
| D405,851 | S | * | 2/1999 | McBride | D21/662 |
| D407,770 | S | * | 4/1999 | Thomas | D21/679 |
| 5,891,003 | A | | 4/1999 | Deac et al. | 482/106 |
| 5,897,471 | A | * | 4/1999 | Multanen et al. | 482/44 |
| 6,010,436 | A | * | 1/2000 | Obery et al. | 482/93 |
| 6,022,302 | A | * | 2/2000 | McBride | 482/121 |
| 6,132,344 | A | | 10/2000 | Vanderbleek | 482/108 |
| 6,149,557 | A | * | 11/2000 | Williams et al. | 482/105 |
| 6,190,292 | B1 | * | 2/2001 | Panes | 482/93 |
| 6,217,495 | B1 | * | 4/2001 | Yalch | 482/109 |
| 6,261,211 | B1 | * | 7/2001 | Suarez et al. | 482/107 |
| 6,293,893 | B1 | * | 9/2001 | Truchelut | 482/121 |
| 6,386,988 | B1 | * | 5/2002 | Shearer et al. | 473/220 |
| D517,135 | S | * | 3/2006 | Klein | D21/679 |
| 2002/0155933 | A1 | * | 10/2002 | Chen | 482/148 |

FOREIGN PATENT DOCUMENTS

| | | |
|---|---|---|
| WO | WO 90/00436 | 5/1990 |
| WO | WO 92/04945 | 4/1992 |
| WO | 93/23120 | 11/1993 |

* cited by examiner

*Primary Examiner*—Glenn Richman
(74) *Attorney, Agent, or Firm*—Jeff Klembczyk, Esq.

(57) ABSTRACT

A wellness apparatus consisting of elastic material in which vibrations can be stimulated. Weights can be added to the ends of the object to allow different exercise purposes. The apparatus is provided for the fitness, wellness, leisure sports and aerobics field.

17 Claims, 2 Drawing Sheets

WELLNESS APPARATUS

BACKGROUND OF THE INVENTION

The invention relates to a wellness apparatus made from elastic material, consisting essentially of a rod or bar-shaped object.

Kinetic therapy apparatus made from elastic material, consisting essentially of a rod or bar-shaped object, are known. Apparatus of this type, as the name already indicates, are meant for the therapeutic treatment of tenseness and for the loosening up of tense muscles.

The known therapy apparatus are used for the treatment of neuromuscular damages, respectively impairments. This is the treatment of a disturbed interaction of nerves and muscles. This can be blockades as well as partial or total interruptions of the usual neural transmission at the motor endplate.

Here the sequences of movements with these known therapy apparatus have to be learned first under the supervision of a therapist, before the patient can start with his own exercises.

A device indicated as therapy apparatus is, for example, known from the DE 199 56 957. The therapy apparatus described here are apparatus whose rod-shaped objects are made from high quality spring steel. The cross section of these known therapy apparatus is circular and has a small cross section surface. A number of weights can be arranged with different distances on the rod-shaped object by means of clamping screws. In order to change the vibration frequency additional absorbing elements can be arranged at the object.

The design in spring steel as well as the design of the weights and the additional arrangement of the absorbing elements result in a high individual weight of these known therapy apparatus which leads to the result that exercises can be carried out only over a short period of time. The handling of the apparatus over a longer period of time is reduced essentially by the high individual weight. Whether in particular a successful influence on the neuro-interaction of nerves and muscles is possible, seems questionable because of the high weight. It is more likely that the exercising person risks a cramp of the musculature and other injuries because of the high weight, so that this apparatus is not suitable for the non-therapeutic field. In addition to that the weights stimulated to vibrations can also be a risk for the health. The production of therapy apparatus of this type is, because of the high requirements for precision, the high quality material as well as the quality demands, which are as a total made on the production of therapeutic apparatus, is very expensive.

From the DE 200 01 973 an aerobics bar made from fiber glass laminate is known. At the ends of the bar unprotected heads with a weight of about 100-150 grams with a corresponding thickness are arranged. The bar also has handles at its sides which allow a use of the bar as expander. The bar is supposed to have a better practice effect on the musculature.

If this bar is stimulated to vibrations, the result are vibrations so large that a neuromuscular treatment by means of this type of design is not possible. The large vibrations are a result of the large elasticity because of the simultaneous use as expander. This aerobics bar therefore only allows exercises for physical training without influence on the neuromuscular system. In addition to that the danger of injuries through the weights provided at the ends is enormous.

The object of the invention, based on the therapy apparatus described above, is to provide a safe apparatus, which can be used in the field of wellness, sports and leisure as well as in the aerobics. The use for carrying-out of exercises for strengthening the musculature in the neuromuscular field shall be possible for everybody without the supervision of a therapist.

BRIEF DESCRIPTION OF THE INVENTION

The invention provides a wellness apparatus consisting of elastic material, in particular material, in which vibrations can be stimulated, comprising essentially a rod or bar-shaped object wherein at the rod or bar-shaped object at its ends, seen in longitudinal direction, protection devices formed as weights are arranged.

The solution according to the invention reaches a protection of the swinging weight and also, if necessary, a protection from the pointed end of the rod. The protection device is made, for example, from an elastic and/or plastic synthetic material (for example polyurethane or polystyrene). There can also be protection caps which are designed in such a way that injuries during transport and during the exercise are avoided. In particular the protection caps should have curved edges. A protection device which projects beyond the object at the circumference makes it easier to grip a wellness apparatus according to the invention which lies on the floor.

The embodiment of the wellness apparatus according to the invention allows the use of such an apparatus for everybody without the supervision of a therapist. For carrying out an exercise or training the apparatus is gripped with one or both hands and held in front of the body. By means of the movements of the body, respectively easy movements of the hands or arms or the upper body the object is stimulated specifically to vibrations. These vibrations have to be balanced by the musculature. Through the protection device, respectively the protection caps, the exercising person is protected perfectly from the weights swinging in front of his or her body.

Low impact as well as high impact power stamina training in the area of the muscle-skeleton-system is possible. In particular a strengthening of the body musculature can be achieved. The vibrations of the object once stimulated to vibrations are transmitted to the musculature and have to be balanced. Thus at the same time a co-ordination training of the stressed muscles is obtained.

Misbalance/tenseness of the musculature can be balanced. The sum of the strain impulses resulting from the vibrations leads to adjustment reactions of the neuromuscular system. Thus also a rehabilitative training with the wellness apparatus according to the invention is possible. Simple exercises up to co-ordinatively complex exercises can be carried out with the wellness apparatus. Here an isometric as well as a dynamic workout can be carried out with three dimensional movements.

In a further embodiment it is also provided that the protection devices can be exchanged wherein the protection devices have different weights. By means of the changes at the weights of the protection devices the vibration attitude of the wellness apparatus according to the invention can be changed. Thus a higher intensity of the exercise, respectively, if the strain is too high, a reduction of the intensity of the stress through the exercises can be obtained.

Conventionally it is provided that the protection device is designed in three weight classes: light, medium, heavy.

A further embodiment of the solution according to the invention suggests that a number of weights can be mounted and fixed, additionally to the protection devices, to the rod or bar-shaped object. Depending on the way of exercises, which should be carried out, thus a change of the vibration attitude and therefore a change of the strain of the muscles, respectively the movement co-ordination, which shall be influenced, can be achieved. These additional weights act in particular also as absorbing weights. It is further preferred if the protection devices and absorbing weights are made from elastic, preferably rubber-like material.

According to another aspect of the solution according to the invention it is provided that between the weights absorbing elements are arranged. These absorbing elements may be designed tube-like, e.g. from rubber-like material. These tube-like designed absorbing elements are also drawn over the rod or bar-shaped object.

Another embodiment of the invention provides that the weights are designed in such a way that they can, on the one hand, be adjusted or shifted on the rod or bar-shaped object, on the other hand, that the material forming the weights has enough tension force in order to fix the absorbing weights axially.

This way of an embodiment of wellness apparatus according to the invention allows an economic design of such a wellness apparatus.

A further development of the invention provides that the elastic material of the rod or bar-shaped object is at least partially made from synthetic material.

The elastic material of the rod or bar-shaped object may be completely or at least partially made from a glass fiber synthetic compound.

Further it is possible that the elastic material of the rod or bar-shaped object is completely or partially produced from a carbon fiber compound.

According to the invention it has also been found that it is an advantage if the elastic material of the rod or bar-shaped object is designed as a fiber glass fiber.

It is further possible to use a synthetic material fiber compound as elastic material for the rod or bar-shaped object.

One advantage of the use of synthetic material (or synthetic compound or synthetic fiber materials) is that these materials have a small specific density, and this keeps the weight of the whole invention low. Naturally, any vibration attitude of the object can be adjusted by means of the combination of the material, for example the addition of suitable fiber material as indicated. At the same time also the resistance against breaking or wearing of the wellness apparatus according to the invention is raised. The same is also achieved through the layer or sandwich construction mentioned below.

The type of the chosen materials, respectively the material compounds, allows furthermore a very light design. Therefore it is possible that the weight of the apparatus is less than 1.0 kg, preferably, depending on the size of the wellness apparatus, between 300 g and 600 g. By means of that also an economic wellness apparatus is reached because the materials can be provided cheaply, and also a production in series can easily be carried out.

Through the low weight and little strain for the joints a training for persons of all ages is possible.

Another aspect of the compound of an elastic material is given by the fact that a caoutchouc silicone compound serves as material for the rod or bar-shaped object.

Furthermore it has been found that it is an advantage if a caoutchouc silicone fiber compound serves as elastic material for the rod or bar-shaped object.

A convenient embodiment provides that rubber or rubber-like materials are used as elastic material.

In another embodiment of the solution according to the invention it is provided that wood serves as elastic material of the rod or bar-shaped object.

In particular also spring steel or the like can be used as material for the rod-like object.

According to the invention it is suggested that the elastic material is formed by a compound material, consisting of the materials mentioned before. Therefore it is possible to provide apparatus with different vibration attitude for different exercise variations. Especially the use of comparatively "rigid" materials allows, in an elegant manner, to vary the vibration attitude, and, if necessary, at the same time the appearance. The same goes for a sandwich construction.

In a further embodiment of the solution according to the invention it is provided that the elastic material is a layer material in sandwich construction which consists of one or more materials.

The cross section of the wellness apparatus can be circular, oval, rectangular or square. Here the cross section of the bar-shaped object can be varied in such a way that in the width dimensions of about 4.0 cm to 10.0 cm, preferably 6.0 cm, in the height of about 0.5 cm to 2.0 cm, preferably 1.0 cm or in the diameter of 0.5 to 6.0 cm, preferably 2.5 cm and in the length 80.0 cm to 200.0 cm, preferably 150.0 cm can be achieved. Here the dimensions of the rod-shaped object can be varied in such a way that different vibrations for different exercise intensities can be obtained.

By means of the above described embodiment of the solution according to the invention it is possible that the weight of the apparatus is less than 1.0 kg, preferably about 300 g to 600 g.

Another aspect of the invention is that in the center of the rod or bar-shaped object material is arranged which envelops the object and which is preferably designed as grip.

However, it is also provided that the rod or bar-shaped object has, in its center, depending on the embodiment, an enlargement or a diminution designed as grip, which allows to grip the object and hold it during the exercises.

The material enveloping the rod or bar-shaped object can be rubber-like, tissue-like, preferably made from textile tissue.

It is, in particular, possible that the whole rod or bar-shaped object according to an embodiment described above is enveloped by a protective covering. This leads, on the one hand, to a certain protection of the whole wellness apparatus, and it is, on the other hand, possible also to shape the apparatus according to the different requirements. Furthermore the vibration attitude of the whole apparatus may also be influenced by this protective covering.

As it is clear from the above mentioned features the wellness apparatus can be used as fitness, leisure sport or aerobics apparatus. The handling is simple, everyone can learn its exercises easily and without additional instruction.

Another aspect is, that, because of the small individual weight and the low dimensions this wellness apparatus can be transported easily so that it can be used in different places without problems.

Another solution of the object presented by the invention is provided by the use of a rod or bar-shaped object made from elastic material which can, in particular, be stimulated to vibrations as sports apparatus, in particular in the field of fitness, wellness, leisure sport or aerobics.

The use aims in particular to the use of a rod or bar-shaped object whose material consists at least partially of spring steel or synthetic material or a glass fiber synthetic compound or a carbon fiber compound or a fiber glass fiber compound or a synthetic fiber compound or a caoutchouc silicone compound or a caoutchouc silicone fiber compound or a rubber or rubber-like material or wood.

The forms of use described above of rod or bar-shaped objects are aimed at an embodiment where the material of the rod or bar-shaped object is formed by one of the material components mentioned above.

However, it is also possible to obtain a combination of the different materials with each other as a layer material compound.

Furthermore a use of a rod or bar-shaped object is provided the material of which consists of a compound material, one or more of the material types or compounds described above.

Another aspect of the solution according to the invention concerns the use of the object according to the forms of use mentioned above which is characterised by the fact that the object is designed as a wellness apparatus according to one or more of the above mentioned suggestions.

A further aspect of the solution according to the invention is the use of an object according to one or more of the suggestions described above which is characterised by the fact that the object is held vertically or horizontally, is stimulated to vibrations and, because of, the periodic movement allows a stress of the musculature sufficient to indicate it for therapy purposes.

According to a further embodiment of the solution according to the invention it is provided that in addition to the stress of musculature for holding the object exercises are provided for other muscle regions of the body, for example simultaneous running and/or aerobics exercises.

BRIEF DESCRIPTION OF THE DRAWINGS

The invention is presented diagrammatically with embodiments, respectively drawings.

DETAILED DESCRIPTION OF THE PREFERRED EMBODIMENTS

Figure 1:
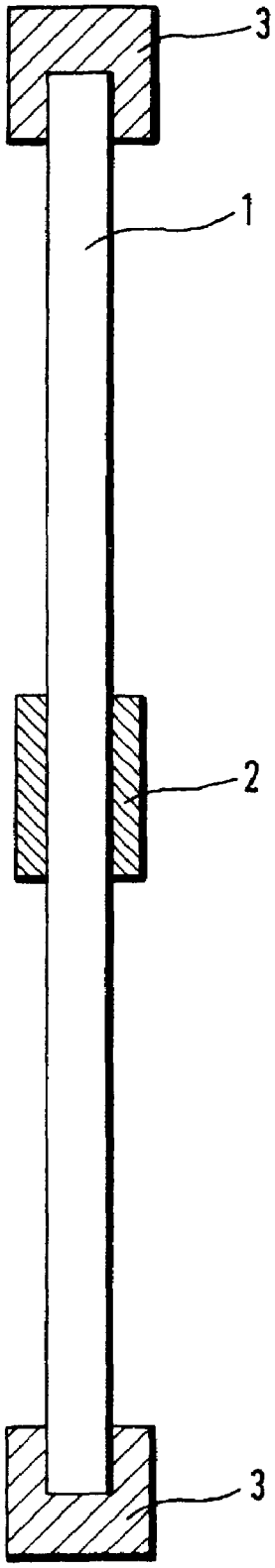
FIG. 1 is a simple embodiment of the wellness apparatus according to the invention.

FIG. 1 shows a simple embodiment of a wellness apparatus according to the invention. Reference number 1 presents the rod or bar-shaped object (basic body). This rod or bar-shaped object may consist of different materials. The cross section of the rod or bar-shaped object can be circular, oval, rectangular or square. However, this is not important for the drawing. In the center of the rod or bar-shaped object 1 the grip 2 is arranged for better handling of the apparatus. Grip 2 is designed in the embodiment shown as material enveloping the object, that is, it has been provided in its center with a boring and has then been drawn over the rod or bar-shaped object until it is positioned in the center of the object. Then it is fixed there by appropriate fixing agents. This can be carried out, for example, by gluing. However, it also may be possible, that the material itself has tension forces which are sufficient to hold the material designed as a grip permanently in its eventually chosen position. Protective devices 3 are arranged at the ends, seen in longitudinal direction of the rod or bar-shaped object 1. These protective devices 3 are designed in the presented example as protecting caps. At each of their sides pointing outwards curves may be provided so that injuries during transport and carrying out of the exercises can be avoided. In order to keep the drawing simple presentation of the curves has been omitted. The protective devices 3 are designed in such a way that they can be exchanged. It is especially preferable when these protective devices 3 have different weights so that different grades of strain of the musculature, respectively different demands to the ability of co-ordination can be made.

Figure 2:
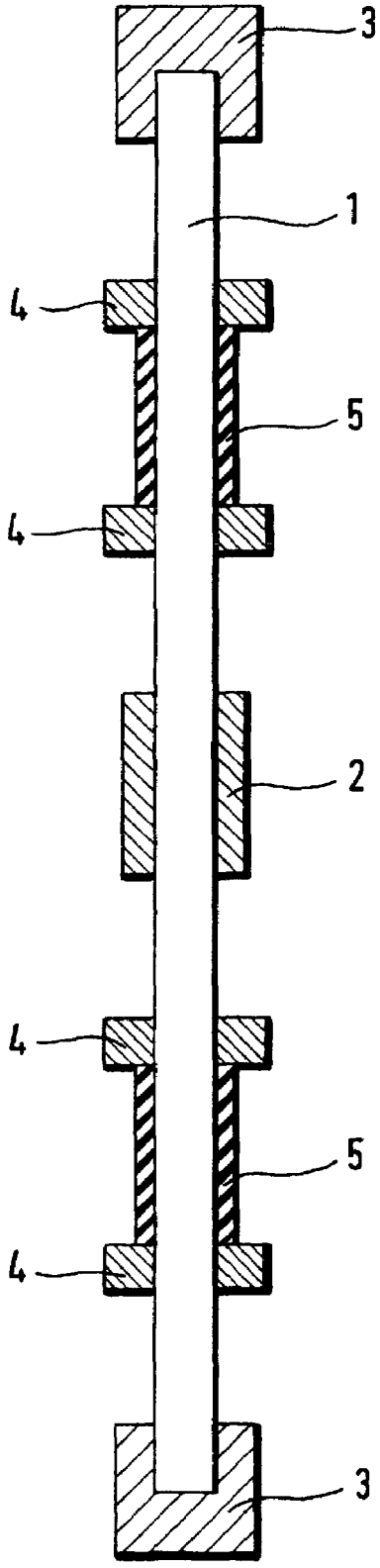
FIG. 2 is a specially designed wellness apparatus with additional weights and absorbing elements.

In FIG. 2 a wellness apparatus is described where, in addition to the features already described, weights 4 are arranged at the rod or bar-shaped object 1. These weights 4 are arranged as additional weights to the own weight of the protective device 3 at the object 1. Here the weights 4 can be varied in their distance to each other and in their distance from the center of the rod or bar-shaped object 1. Between two weights 4 an absorbing element 5 is arranged. This absorbing element 5 may be designed for example as a tube-like object, similar to a protective tube for a shock absorber. Because of the simple presentation also here only a parallel embodiment has been chosen. It is convenient here when this absorbing element has itself elastic properties. As already explained in the description, by means of this absorbing element a further adjusting to the desired vibration attitude of the whole wellness apparatus can be achieved.

Figure 3:
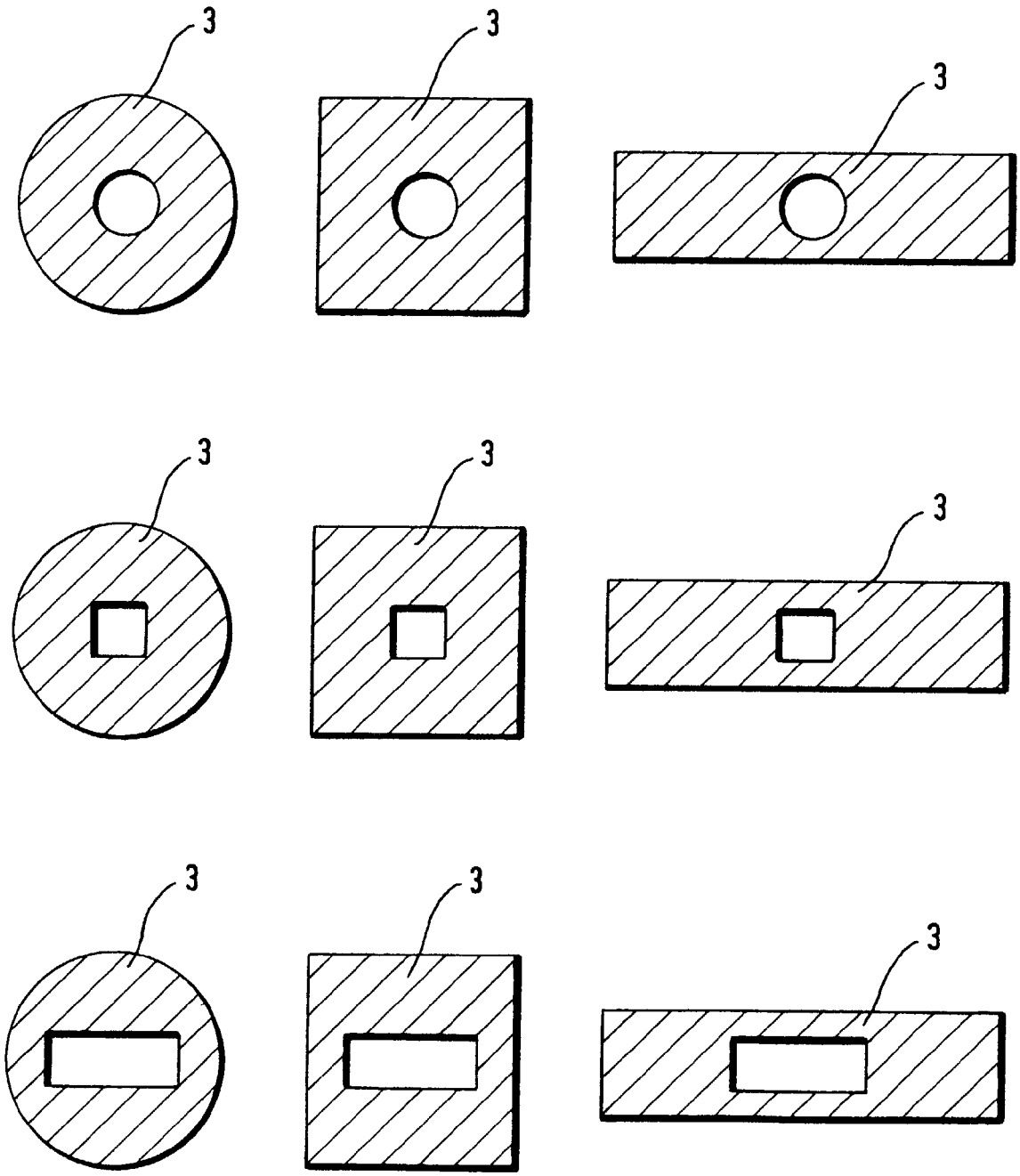
FIG. 3 is a sectional drawing of several embodiments of the protecting caps, respectively the weights.

In FIG. 3 several embodiments of the protecting caps 3, respectively the weights 4 are shown in a sectional drawing. The difference is only that in the embodiment as a weight 4 a continuous boring is provided, while in the embodiment as a protective cap the boring is preferably not continuous. As it can be seen in FIG. 3, in the core of the protective cap 3, respectively the weight 4, a boring or an opening is provided which corresponds to the form of the rod or bar-shaped object 1.

The claims submitted with the application now and to be submitted later on constitute attempts at wording without prejudice to the obtaining of continuing protection.

The relationships cited in the dependent claims refer to the further development of the subject of the main claim provided for by the features of the respective sub-claim. However, these relationships must not be interpreted as waiving the requirement to obtain independent, subjective protection for the features of the related sub-claims.

Features which so far have only been disclosed in the description may be claimed in the course of the proceedings as being of significance to the invention, for example for delimitation from the prior art.

The invention claimed is:

1. Wellness apparatus in which periodic vibrations are stimulated, said wellness apparatus comprising a flexible rod or bar-shaped object of circular cross section having two opposite ends, the flexible rod or bar-shaped object being made from an elastic material, wherein said elastic material of said rod or bar-shaped object is at least partially made from one of a synthetic material and a synthetic material fiber compound, removably mounted protection devices formed as weights and each having a partial bore that is not continuous through each device such that the protection devices envelope and cap the two opposite ends and at least portions of side surfaces of the rod, which affect vibration attitude of the apparatus, and a material enveloping the flexible rod or bar-shaped object at a center of the rod or bar-shaped object and being spaced axially along the flexible rod or bar-shaped object from the protection devices, the material forming a center grip, said center grip being axially fixed at the center of the flexible rod or bar-shaped object by tension forces, and through which the periodic vibrations are induced in the apparatus by a user holding the center grip, a number of weights, each having a continuous bore extending entirely through the weight, and being mounted and fixed to said rod or bar-shaped object between the protection devices and the grip, said weights being adjustable on said rod or bar-shaped object, wherein said weights and said protection devices and said grip are each formed of a material, the material having tension force of a sufficient magnitude to be the only force fixing said weights and protection devices and grip axially on said rod or bar-shaped object, wherein a total weight of the apparatus is smaller or equal to 1.0 kg.

2. Wellness apparatus according to claim 1, wherein absorbing elements are arranged between said weights.

3. Wellness apparatus according to claim 2, wherein said protection devices and said absorbing elements are formed from elastic material.

4. Wellness apparatus according to claim 1, wherein said elastic material of said rod or bar-shaped object is a carbon fiber compound.

5. Wellness apparatus according to claim 1, wherein said elastic material of said rod or bar-shaped object is a rubber material.

6. Wellness apparatus according to claim 1, wherein said elastic material of said rod or bar-shaped object is obtained from wood.

7. Wellness apparatus according to claim 1, wherein said elastic material of said rod or bar-shaped object is one of a caoutchouc silicone and a caoutchouc silicone fiber compound.

8. Wellness apparatus according to claim 1, wherein said elastic material of said rod or bar-shaped article is spring steel.

9. Wellness apparatus according to claim 1, wherein said elastic material is formed by a compound material, consisting of one or more of a synthetic material, a synthetic fiber material compound, a carbon fiber, rubber, wood, caoutchouc silicone, caoutchouc silicone fiber compound and spring steel materials.

10. Wellness apparatus according to claim 1, wherein said elastic material is a layer material in sandwich construction, consisting of one or more of a synthetic material, a synthetic fiber compound, carbon fiber, rubber, wood, caoutchouc silicone, caoutchouc silicone fiber compound and spring steel materials.

11. Wellness apparatus according to claim 1, wherein said cross section of said object has dimensions in a width of about 4.0 cm to 10.0 cm, in a height of about 0.5 cm to 2.0 cm, and in a length of about 80.0 cm to 200.0 cm.

12. Wellness apparatus according to claim 11, wherein said dimensions of said object are diversified in such a way to produce different vibrations for different practice intensities.

13. Wellness apparatus according to claim 1, wherein said material enveloping said object is textile tissue.

14. Wellness apparatus according to claim 1, wherein said rod or bar-shaped object is used as one of a fitness, leisure sport and aerobics apparatus.

15. Use of said bar or rod-shaped object according to claim 1, wherein said rod or bar-shaped object is stimulated by vibrations and allows, because of a periodic movement, a stress of muscles for therapeutic purposes.

16. Use of said bar or rod-shaped object according to claim 15, wherein said stress of said muscles is used in at least one of running and aerobics exercises.

17. Wellness apparatus in which periodic vibrations are stimulated, said wellness apparatus comprising a rod or bar-shaped object of circular cross section having two opposite ends and made from an elastic material, wherein said elastic material is at least partially made from one of a synthetic material and a synthetic material fiber compound, removably mounted protection devices formed as weights and each having a partial bore that is not continuous through each device such that the protection devices envelope and cap the two opposite ends and at least portions of side surfaces of the rod, and which affect vibration attitude of the apparatus, a material enveloping the rod or bar-shaped object at a center of the rod or bar-shaped object, the material forming a center grip and the material having tension forces which are sufficient to fix the grip axially at the center of the rod or bar-shaped object, and through which the periodic vibrations are induced in the apparatus by a user holding the center grip, and a total weight of the rod or bar-shaped object, protection devices and center grip is less than 1.0 kg, and a number of weights, each having a continuous bore extending entirely through the weight, and being mounted and fixed on said rod or bar-shaped object between the center grip and the protection devices, said weights being adjustable on said rod or bar-shaped object, wherein said weights and said protection devices and said grip are each formed of a material, the material having tension force of a sufficient magnitude to be the only force fixing said weights and protection devices and grip axially on said rod or bar-shaped object.

* * * * *